US008081085B2

(12) United States Patent
Jerg et al.

(10) Patent No.: US 8,081,085 B2
(45) Date of Patent: Dec. 20, 2011

(54) HOUSEHOLD APPLIANCE WITH PROJECTED DISPLAY

(75) Inventors: Helmut Jerg, Giengen (DE); Thomas Wachinger, Hohenzell (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 375 days.

(21) Appl. No.: 12/311,596

(22) PCT Filed: Oct. 18, 2007

(86) PCT No.: PCT/EP2007/061150

§ 371 (c)(1),
(2), (4) Date: Apr. 3, 2009

(87) PCT Pub. No.: WO2008/046884

PCT Pub. Date: Apr. 24, 2008

(65) Prior Publication Data

US 2009/0224933 A1 Sep. 10, 2009

(30) Foreign Application Priority Data

Oct. 19, 2006 (DE) ..... 10 2006 049 396

(51) Int. Cl.
*G08B 5/00* (2006.01)

(52) U.S. Cl. ..... 340/815.4; 62/125; 134/113; 340/500; 340/815.45

(58) Field of Classification Search ..... 340/500, 340/540, 635, 691.1, 691.2, 691.6, 815.4, 340/815.45, 815.5, 679; 62/125; 134/113; 361/680; 381/42

See application file for complete search history.

(56) References Cited

U.S. PATENT DOCUMENTS

| | | | | |
|---|---|---|---|---|
| 6,196,239 | B1 * | 3/2001 | Eskey | 134/113 |
| 6,700,500 | B1 * | 3/2004 | Burnett | 340/545.6 |
| 7,296,236 | B2 * | 11/2007 | King | 715/746 |
| 7,308,186 | B2 * | 12/2007 | Kaczmarek | 340/815.42 |
| 7,766,525 | B2 * | 8/2010 | Rosenbauer et al. | 362/551 |
| 2003/0209018 | A1 | 11/2003 | Becke et al. | |
| 2003/0230017 | A1 * | 12/2003 | Geyer | 40/544 |
| 2006/0232997 | A1 | 10/2006 | Rosenbauer et al. | |
| 2006/0280422 | A1 * | 12/2006 | Kaczmarek | 385/147 |
| 2008/0106429 | A1 | 5/2008 | Kaczmarek et al. | |

FOREIGN PATENT DOCUMENTS

| | | | |
|---|---|---|---|
| DE | 10255006 | A1 | 6/2004 |
| DE | 10259763 | A1 | 7/2004 |
| DE | 102004062751 | A1 | 7/2006 |
| EP | 691100 | A1 * | 1/1996 |
| EP | 0691100 | B1 | 5/1999 |
| EP | 1421893 | A1 * | 5/2004 |
| EP | 1489364 | A1 | 12/2004 |
| WO | WO 2006013009 | A1 * | 2/2006 |
| WO | 2006069831 | A1 | 7/2006 |
| WO | WO 2006069831 | A1 * | 7/2006 |
| WO | 2006133998 | A1 | 12/2006 |

* cited by examiner

*Primary Examiner* — Eric M Blount

(74) *Attorney, Agent, or Firm* — James E. Howard; Andre Pallapies

(57) ABSTRACT

A water-conducting domestic appliance including a door having a handle, and display means for displaying an operating state of the domestic appliance by projecting a light projection, wherein the display means are disposed in the handle of the door.

19 Claims, 1 Drawing Sheet

HOUSEHOLD APPLIANCE WITH PROJECTED DISPLAY

The present invention relates to a domestic appliance, in particular a water-conducting domestic appliance, with display means for displaying the operating state by means of light projection and with a door with a handle.

BACKGROUND OF THE INVENTION

Domestic appliances, for example water-conducting domestic appliances such as dishwashers and also refrigerators, in which operating elements and/or display elements which provide information about the operating state of the appliance are disposed in a covered manner such that they can no longer be perceived visually by an operator when the door of the domestic appliance is closed, thus not having a negative effect on the aesthetic appearance of the domestic appliance, are increasingly available. However they pose the problem that in the case of particularly quiet domestic appliances an operator is then unable to discern whether or not a dishwasher for example has completed a wash program. This can only be established by opening the door of the domestic appliance and thereby interrupting the wash program. Various proposed solutions are known in the prior art to allow the operating state to be displayed nevertheless.

For example a dishwasher is known from EP 0 691 100 B1, in which an illuminated signal facility is integrated in the end face of a door in such a manner that when the door is closed, it cannot be perceived visually by an operator. In order to conduct a visual signal from the illuminated signal facility to the front face of the domestic appliance, light-conducting means are provided to forward the light signal according to EP 0 691 100 B1.

In contrast a domestic appliance, in which illuminating means are disposed in the region of a recessed base strip and are configured to project a spot of light onto the floor region in front of the domestic appliance, thus allowing information to be provided about the operating state of the domestic appliance, is known from DE 102 55 006 A1.

However in this instance the visibility of the projected light signal serving to provide information about the status of the domestic appliance is a function of the optical properties of the floor covering. This can mean that the light signal is difficult to discern due to poor optical properties of the floor covering.

SUMMARY OF THE INVENTION

The object of the invention is therefore to provide an improved domestic appliance, in which the visibility of the light projection is reliably ensured regardless of external ambient conditions.

The inventive domestic appliance, in particular a water-conducting domestic appliance, has display means for displaying the operating state by means of light projection and a door with a handle. The domestic appliance here is what is known as a fully integrated domestic appliance, having no operating and/or display elements on its front face but instead with display means being provided, which allow the operating state to be displayed by means of light projection. The domestic appliance also has an interior, which can be opened and closed by means of a door, the door having a handle for this purpose. According to the invention provision is made for the display means to be disposed in the handle. In this way the arrangement of the display means in this position does not impair the aesthetic appearance.

Provision is preferably made for the display means to be configured to project light onto the door. This ensures that a defined background is provided for the light projection indicating the operating state, so that maximum visibility of the light projection is ensured regardless of ambient influences or the location of the domestic appliance.

In a preferred embodiment provision is made for the display means to be configured so that they cannot essentially be perceived in a tactile manner, so that they do not impair the functionality of the handle for opening and closing the door.

Provision is also preferably made for the handle to have a section facing the door, in which the display means are disposed. An operator can however only see this section of the handle with difficulty, so that such an arrangement in the handle means that the display means are essentially invisible to an operator and therefore do not influence the aesthetic appearance of the domestic appliance in a negative manner.

The light projection for displaying the operating state of the domestic appliance can take place onto any region of the domestic appliance. Provision is however preferably made for the display means to be configured to project onto a section of the door above the handle, so that the light projection is disposed at the most visible point on the domestic appliance.

In one embodiment provision is made for the display means to be connected to a control unit of the domestic appliance by means of an electrical line, a section of which runs through the handle. The control unit then generates electrical signals, which reflect the operating state of the domestic appliance. For forwarding purposes an electrical line is provided, which extends through the handle and connects the control unit of the domestic appliance to the display means. The display means can be electric lamps, laser diodes, luminescent diodes, LEDs or other suitable illuminating means. The illuminating means can be configured to generate light of different colors and/or intensities in order to display an operating state by means of a previously specified intensity or color selection. The display means can also be configured to project different symbols, such as remaining running times for example.

In one alternative embodiment provision is made for the display means to be connected to a control unit of the domestic appliance by means of an optical waveguide, a section of which runs through the handle. In this instance the control unit has light means of the above-mentioned type, which are connected directly to the optical waveguide, which is passed through a channel extending through the handle and exits into the open through an exit opening at its other end, so that light projection onto a desired surface is possible.

In a further alternative embodiment of the invention provision is made for the display means to be connected to the control unit of the domestic appliance by means of at least one channel, a section of which runs through the handle. Reflection means can also be provided, to establish a connection from a first to a second channel, to achieve light projection on a desired region.

Provision can also preferably be made for the handle to be provided with sensor switches, which are connected in an electrically active manner to the control unit such that when the hand of an operator touches or approaches the handle, the control unit is activated and displays the current operating state by means of light projection. This allows simple verification of the operating state, without there being permanent light projection during operation. Provision can also be made for the control unit to generate an acoustic warning signal in the case of ongoing operation, to indicate to an operator that opening the door using the handle would cause a program to be interrupted. Provision can also be made for the control unit to be configured and to be actively connected to a door lock such that in the event of unwanted opening during ongoing operation of the domestic appliance, the door is totally locked or opening is clearly impeded to prevent unintentional opening of the door during ongoing operation but to allow the door still to be opened quickly in the event of a problem.

BRIEF DESCRIPTION OF THE DRAWINGS

The invention is described below with reference to a drawing, in which.

DETAILED DESCRIPTION OF EXEMPLARY EMBODIMENTS OF THE PRESENT INVENTION

Figure 1:
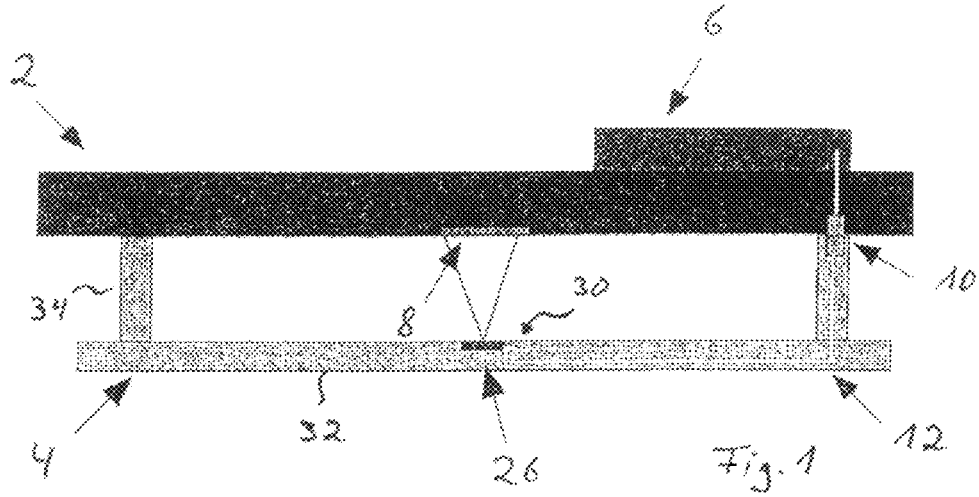
FIG. 1 shows a schematic diagram of an exemplary embodiment of the invention.
Figure 2:
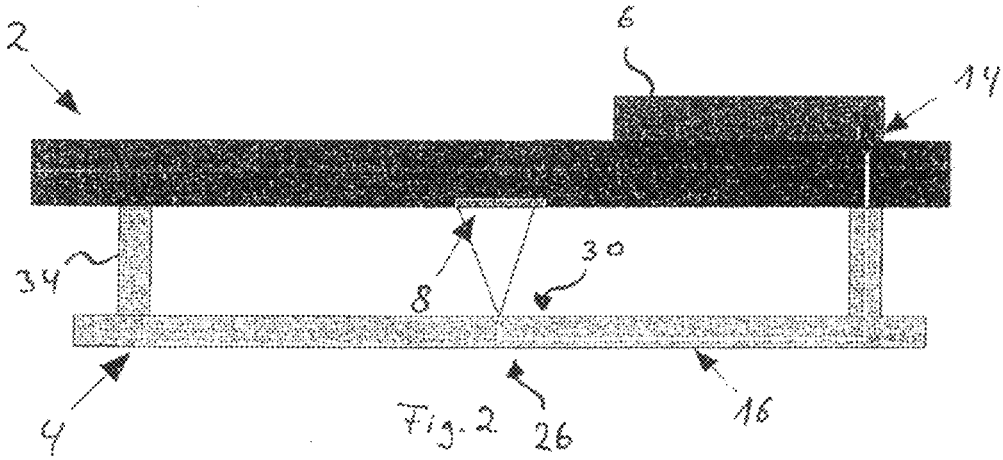
FIG. 2 shows a schematic view of a second exemplary embodiment of the invention.
Figure 3:
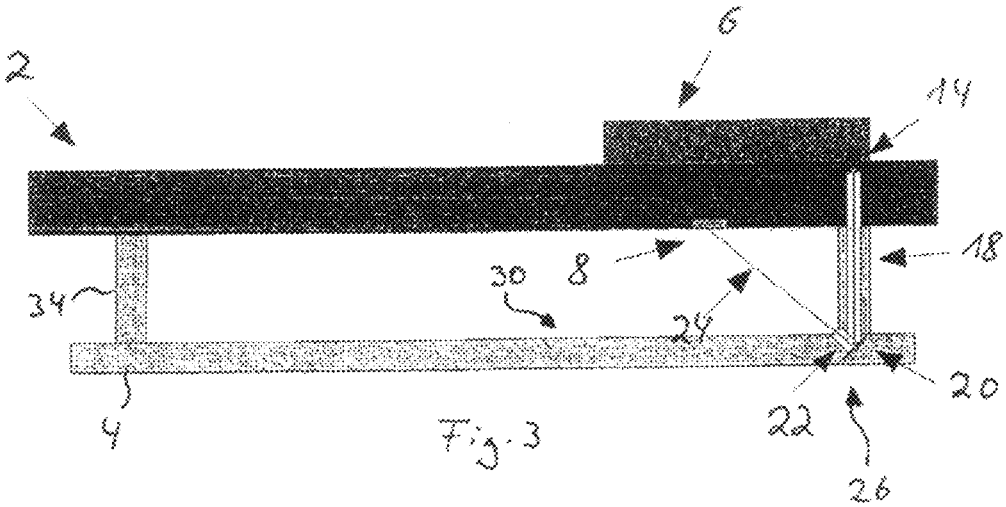
FIG. 3 shows a schematic view of a third exemplary embodiment of the invention.

Reference is made to FIGS. 1 to 3.

Illustrated is a door secured in a pivotable manner to the housing of a domestic appliance, for example a dishwasher. The door 2 can be opened and closed by means of a handle 4, to load or unload the interior of a domestic appliance.

In the present exemplary embodiment a control unit 6 is disposed on the inside of the door 2, it being possible for this to be configured to control the domestic appliance as a whole or alternatively just to generate signals representing the operating state of the domestic appliance.

The handle 4 has a handle bar 32, which can be made of metal for example and has a round cross-sectional profile. The handle bar 32 is secured to the door 2 by means of two connecting elements 34. The handle bar 32 has an inside 30 facing the door, in which a display element 26 is recessed, being configured to generate a light projection onto a section above the door 2 above the handle 4 or handle bar 32. The arrangement of the display means 26 in a recess means that the display means 26 are arranged in the handle bar with almost no elevation and can therefore scarcely be perceived in a tactile manner.

An electrical connection between the control unit 6 and the display means 26 is established by means of a plug-in connection 10 and an electrical conductor 12, the electrical plug-in connection 10 expediently having a connecting element 34 to the side facing the door 2 in the connecting region, to facilitate assembly. The electrical line 12 extends through holes provided in the handle bar 32 and the connecting element 34.

In a second exemplary embodiment (see FIG. 2) the control facility 6 has a light source 14, for example a laser diode, an LED or another suitable light source, which is connected to an optical waveguide 16, which is likewise located in a channel extending through the handle bar 32. An exit opening for the optical waveguide 16 is provided at a desired point on the handle bar 32, so that light projection is possible.

In a third exemplary embodiment (see FIG. 3) the control unit 6 likewise has a suitable light or signal source, the connecting element 34 having a hole for a light beam generated by the light source 14. To generate a light projection the handle bar 32 also has a deflector element, such as a mirror 20 for example, adjacent to which is a further hole 22 opening toward the door 2 and allowing the light beam generated by the light source 14 to exit from the channel 22 after being reflected by the mirror 20 and to be projected onto the surface 8.

LIST OF REFERENCE CHARACTERS

2 Door
4 Handle
6 Control unit
8 Surface
10 Plug-in connection
12 Electrical conductor
14 Light source
16 Optical waveguide
18 Channel
20 Mirror
22 Second channel
24 Light beam
26 Display means
30 Inner surface
32 Handle bar
34 Connecting element

The invention claimed is:

1. A water-conducting domestic appliance comprising:
a door having a handle; and
display means for displaying an operating state of the domestic appliance by projecting a light projection,
wherein the display means are disposed in the handle of the door.

2. The domestic appliance as claimed in claim 1, wherein the display means project the light projection onto the door.

3. The domestic appliance as claimed in claim 1, wherein the display means are substantially imperceptible in a tactile manner.

4. The domestic appliance as claimed in claim 1,
wherein the handle includes a section facing the door, and
wherein the display means are disposed in the section facing the door.

5. The domestic appliance as claimed in claim 1, wherein the display means project the light projection onto a surface of the door above the handle.

6. A water-conducting domestic appliance comprising:
a door having a handle;
display means for displaying an operating state of the domestic appliance by projecting a light projection, wherein the display means are disposed in the handle of the door;
a control unit; and
an electrical line connecting the display means to the control unit, wherein at least a portion of the electrical line runs through a part of the handle.

7. A water-conducting domestic appliance comprising:
a door having a handle;
display means for displaying an operating state of the domestic appliance by projecting a light projection, wherein the display means are disposed in the handle of the door;
a control unit; and
an optical waveguide connecting the display means to the control unit, wherein at least a portion of the optical waveguide runs through a part of the handle.

8. A water-conducting domestic appliance comprising:
a door having a handle;
display means for displaying an operating state of the domestic appliance by projecting a light projection, wherein the display means are disposed in the handle of the door;

a control unit; and at least one channel connecting the display means to the control unit, wherein at least a portion of the at least one channel runs through a part of the handle.

9. A water-conducting domestic appliance comprising:

a door having a handle;

display means for displaying an operating state of the domestic appliance by projecting a light projection, wherein the display means are disposed in the handle of the door;

a control unit, wherein the handle includes at least one sensor element, and wherein the at least one sensor element is connected to the control unit.

10. Display means for the domestic appliance as claimed in claim 1.

11. The domestic appliance as claimed in claim 1, wherein the handle includes a recess, and wherein the display means are disposed in the recess such that the display means are substantially imperceptible in a tactile manner.

12. The domestic appliance as claimed in claim 1 wherein the display means project the light projection onto a surface of the domestic appliance.

13. The domestic appliance as claimed in claim 1, wherein the light projection forms a symbol.

14. The domestic appliance as claimed in claim 1, comprising:

a deflector element that reflects the light projection from the display means toward a surface of the domestic appliance.

15. The domestic appliance as claimed in claim 1, comprising:

one of operating elements and display elements providing information about the operating state of the domestic appliance, wherein the one of the operating elements and the display elements is disposed in a covered manner such that the one of the operating elements and the display elements is visually imperceptible when the door of the domestic appliance is in a closed state.

16. The domestic appliance as claimed in claim 15, wherein the light projection displayed by the display means displays the operating state of the domestic appliance when the door of the domestic appliance is in the closed state.

17. The domestic appliance as claimed in claim 1, wherein the domestic appliance is a dishwasher.

18. The domestic appliance as claimed in claim 1, wherein the domestic appliance is a refrigerator.

19. A water-conducting domestic appliance comprising:

a door having a handle; and a display that displays an operating state of the domestic appliance by projecting a light projection, wherein the display is in the handle of the door, and wherein the display is oriented to project the light projection onto the door.

* * * * *